United States Patent [19]

Williams

[11] 3,994,275

[45] Nov. 30, 1976

[54] FREE-STANDING, DISPOSABLE FIREPLACE REFLECTOR

[75] Inventor: Marianne M. Williams, Richmond, Va.

[73] Assignee: Marianne M. Williams, Richmond, Va.

[22] Filed: Apr. 21, 1975

[21] Appl. No.: 569,993

[52] U.S. Cl. ..... 126/141; 126/39 M; 126/92 B; 126/274; 229/3.5 MF

[51] Int. Cl.[2] ..... F24B 1/18; F24C 15/22

[58] Field of Search ..... 126/25 R, 92 B, 141, 126/274, 120, 121, 39 M, 130, 131; 229/3.5 MF

[56] References Cited

UNITED STATES PATENTS

| | | | |
|---|---|---|---|
| 1,404,808 | 1/1922 | Taylor | 126/274 X |
| 3,038,463 | 6/1962 | Daymon | 229/3.5 FM X |
| 3,151,068 | 10/1964 | Hurko | 126/39 M |
| 3,159,156 | 12/1964 | Incledon | 126/39 M |
| 3,194,429 | 7/1965 | Bouet | 229/3.5 FM X |

FOREIGN PATENTS OR APPLICATIONS

| | | | |
|---|---|---|---|
| 1,158,792 | 7/1969 | United Kingdom | 126/39 M |
| 379,418 | 9/1932 | United Kingdom | 126/141 |

*Primary Examiner*—William F. 0'Dea
*Assistant Examiner*—Ronald C. Capossela
*Attorney, Agent, or Firm*—Bacon & Thomas

[57] ABSTRACT

A free-standing, disposable fireplace reflector which may be placed in a fireplace behind a fire and effect reflection of both heat and light therefrom into a sitting room. The disposable nature of the reflector also allows it to be used to collect and dispose of burnt embers and the like. In a preferred form, the reflector is comprised of a laminate of aluminum sheeting affixed to a substrate of fire-retardant material.

12 Claims, 7 Drawing Figures

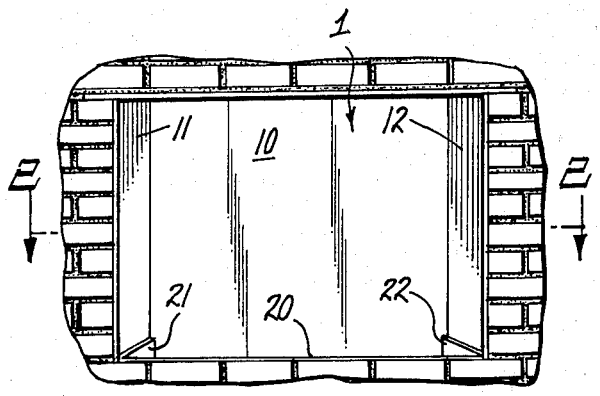
Fig. 1.
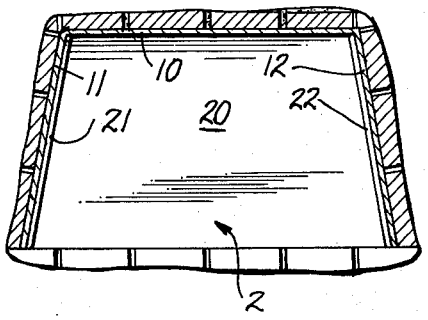
Fig. 2.
Fig. 3.
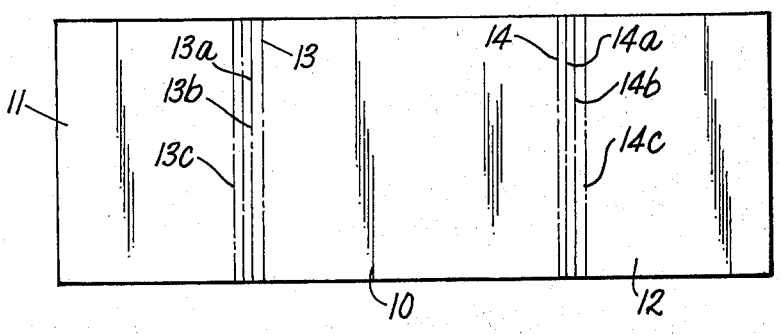
Fig. 4.
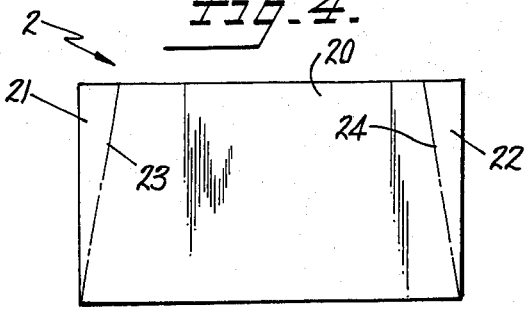

Fig. 5.
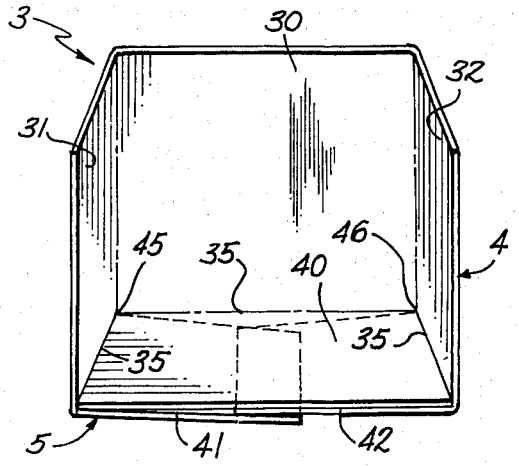
Fig. 6.
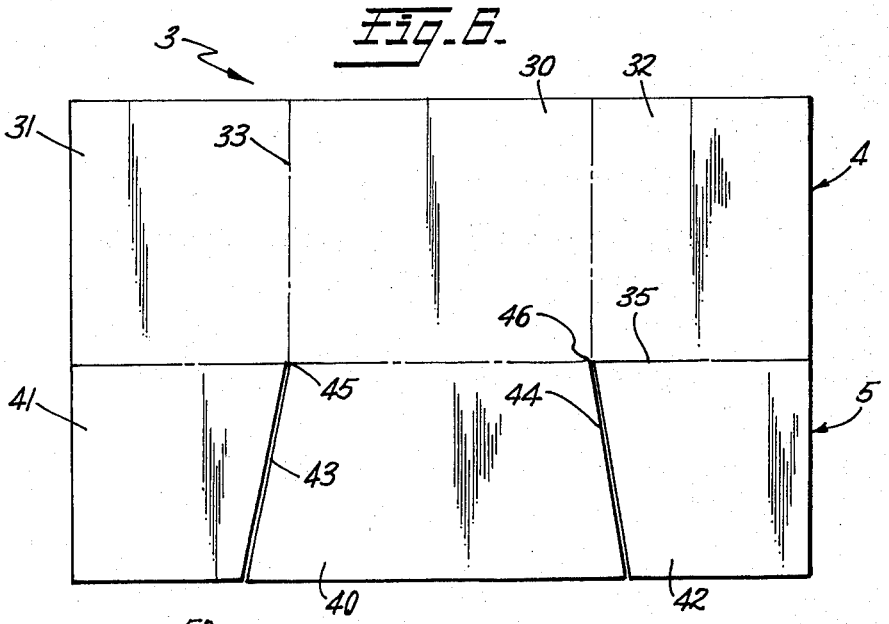
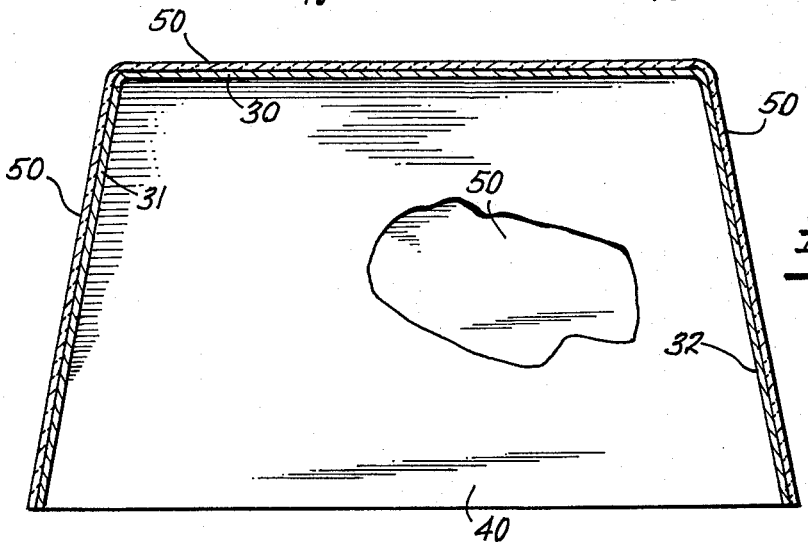
Fig. 7

FREE-STANDING, DISPOSABLE FIREPLACE REFLECTOR

BACKGROUND OF THE INVENTION

Field of the Invention

The present invention relates to free-standing, disposable fireplace reflectors which may be placed behind a fire to reflect both heat and light therefrom into a sitting room. The reflector is disposable and may be conveniently employed as a receptacle for burnt embers, ashes and the like for easy disposal thereof. Additionally, the reflector will provide an added measure of protection to the entire hearth area of the fireplace.

Fireplace reflectors, per se, are well known in the prior art. For example, U.S. Pat. No. 2,825,326 discloses a disposable fireplace reflector of aluminum foil material which is placed behind a fire to reflect heat and light therefrom. The foil is supported upon an auxiliary screen of mesh while is sufficiently pliable to allow a degree of adjustability. U.S. Pat. No. 2,800,127 describes a conceptually identical reflector save for the fact that the aluminum sheeting is supplied from a roll and is collected upon a similar roll until the supply is exhausted.

While such reflectors are indeed effective for their intended purpose, the prior art reflectors require a large degree of permanency in their installation and lack a free-standing capability. Also, these reflectors are structurally incapable of protecting the hearth area, particularly the ash pit.

Accordingly, a need exists for an improved fireplace reflector which is disposable, and free-standing, and which may be easily adjustable over a wide range of fireplace dimensions. Additionally, a need exists for fireplace reflectors of this variety which may be easily employed to collect and dispose of burnt embers, ashes and the like. Furthermore, a need exists for a fireplace reflector which is capable of protecting the hearth area and, particularly, the ash pit.

SUMMARY OF THE INVENTION

The reflector is of unitary, structural configuration for facilitating the manufacturing, transportation and marketing thereof. The reflector is formed with a plurality of fold and perforated cut lines thereby allowing a wide range of adjustability to allow for easy use over a wide range of fireplace dimensions.

To obviate the deficiencies of the prior art, it is the primary object of the present invention to provide a fireplace reflector which is free-standing and disposable.

It is also an object of this invention to provide a fireplace reflector which is of unitary construction and may be readily adjusted to various sizes to accommodate various fireplace dimensions.

It is yet another object of this invention to provide a fireplace reflector which is suitable for containing and disposing of spent or burnt embers, ashes and the like generated upon burning materials in the fireplace.

It is still a further object of this invention to provide a fireplace reflector which is of laminated structure comprising a relatively thin reflective metal foil affixed to a fire-retardant substrate.

It is still a further object of this invention to provide a reflector which is capable of protecting the hearth area and, particularly, the ash pit.

Further objects of this invention will become apparent to those skilled in the art from examination of the following detailed description of the invention when taken in conjunction with the appended claims and figures of drawing.

In accordance with the present invention, a first embodiment of the reflector is comprised of a substantially rectangular reflector with appended support members which are adapted to be bent obliquely with respect to the plane of the rectangular web to afford balancing support therefor. The support members are contiguous with the rectangular web about a weakened fold line extendng transversely across the entirety of the web. Optionally, a ground member may be provided upon which the fire may be kindled. The ground member may be either rectangular in conformity with the longitudinal dimension of the rectangular reflector web, or may be provided with obliquely extending, transverse perforated lines along which the ground member may be folded into substantially trapezoidal configuration whereby the oblique, upstanding edges thereof are adapted for close cooperation with the folded support members of the reflector.

In a second embodiment, the ground member is formed unitarily and contiguous with the upper, reflective portion. A rectangular, reflective web is bisected longitudinally with a weakened fold line forming an upper reflective segment and lower ground segment. The reflective segment is further divided into three portions by two perpendicularly transverse fold lines which extend from the edge of the rectangle and terminate at the longitudinal fold line. The lower, ground segment is also divided into three portions by two, obliquely transverse perforated lines which extend from the edge of the rectangle to the common intersection of the transverse and longitudinal fold lines. To assemble the reflector and integral ground member, one need merely cut along the perforated lines, fold the upper and lower segments into perpendicular relationship and, thence, obliquely fold the outer, upper reflective portions whereby the outer ground members engage in overlapping relationship.

For a fuller and more complete understanding of the intricacies of the present invention, the following detailed description will be given.

BRIEF DESCRIPTION OF THE DRAWINGS

FIG. 1 is a fragmentary front elevational view with a two piece reflector in place according to the present invention;

FIG. 2 is a fragmentary horizontal sectional view, taken on the line 2—2 of FIG. 1;

FIG. 3 is a plan view of the reflector blank for forming the rear and side walls thereof;

FIG. 4 is a plan view of the reflector blank for forming the bottom wall of the reflector of FIGS. 1 and 2;

FIG. 5 is an erected perspective view of a modification illustrating a reflector formed from a single blank;

FIG. 6 is a plan view of the blank for forming the reflector of FIG. 5; and FIG. 7 is an enlarged horizontal sectional view, similar to FIG. 2, showing a reflector having a laminated backing of insulating material.

DETAILED DESCRIPTION OF THE INVENTION

In order to further illustrate the objects and advantages of the present invention, the following detailed description will be given with reference to certain preferred embodiments thereof, the same being intended as illustrative and in no wise limitative.

FIGS. 1 and 2 show a fireplace reflector shield according to the present invention. In this embodiment, the reflector is composed of two, independent, free-standing components: a reflector member designated generally as 1, and a ground member designated generally as 2. As best viewed in FIGS. 3 and 4, each of the reflector and ground members is formed as a substantially rectangular web with a plurality of weakened fold lines therein.

The reflector member 1 is comprised of a central portion 10 bounded on each side by peripheral portions 11 and 12, dependent from central portion 10 about weakened, transverse fold lines 13 and 14, respectively. The peripheral portions 11 and 12 are designed to be bent obliquely with respect to the plane of central portion 10 about transverse fold lines 13 and 14 to provide balancing support for the reflector. FIGS. 1 and 2 illustrate the cooperative nature of the various elements of reflector 1.

The ground member 2 is similarly fabricated in substantially rectangular form and comprises a central portion 20 bounded on either side by peripheral portions 21 and 22, contiguous with central portion 20 about obliquely-extending, transverse weakened fold lines 23 and 24, respectively. For implementation, peripheral portions 21 and 22 are bent obliquely with respect to the plane of central portion 20 and placed upon the hearth of the fireplace as shown in FIGS. 1 and 2. The upstanding, peripheral portions, 21 and 22, are designed to closely cooperate with support members 11 and 12, and further aid in confining the ashes, embers and the like generated from the fire within the hearth area. Additionally, ground member 2 protects the ash pit from over-accumulation of embers and the like, thus minimizing both the need for cleaning thereof as well as the risk of accidental fire in the sub-flooring.

Each of the reflector member 1 and ground member 2 may be fabricated from aluminum sheeting of sufficient integrity to provide the necessary free-standing characteristics. For example, sheeting of .006 inches has been employed with highly satisfactory results. Optionally, each of the components may be fabricated from a laminate of aluminum foil borne upon a fire-retardant substrate such as, for example, asbestos, impregnated cellulosic materials, and the like.

Regardless of the desired materials for fabricating the components, production methodology is simple, efficient and highly economical. The appropriate size web may be stamped from a supply into the desired dimension. Simultaneous with the stamping of the web, the various weakened fold lines may be formed. To provide the broadest range of utility, it is also desirable to optionally form a plurality of closely spaced fold lines as shown in phantom in FIG. 3 as 13*a* –13*c* and 14*a* –14*c*. Similarly, the ground member 2 may be formed with such a plurality of fold lines. Should each of the various fold lines be formed in this fashion, a wide range of adjustability is afforded the reflector shield, and it is easily adaptable over a wide range of fireplace dimensions. Also, the ground member 2 may optionally be formed with longitudinal weakened fold lines (now shown) proximate the longitudinal edges of the web, whereby the ground member 2 may be folded to take on upstanding edges entirely about the periphery thereof, further enhancing the ability of the ground member to retain the spent ashes, embers and the like.

In operation, then, ground member 2 may be simply removed for disposal of the ashes and, upon extended use, may be rolled or folded with the ashes contained therein and easily disposed.

While each of the reflector member 1 and ground member 2 have been described as being formed from substantially rectangular webs of appropriate material, other geometric configurations may be desirable for reasons of, for example, economy of production or to fit a particular fireplace. Thus, it has been determined that the individual shield components, 1 and 2, may be manufactured in substantially trapezoidal configuration without sacrificing the objects and advantages of the present invention.

In the event it is desirable to achieve the economic advantages, reflector member 1 will be formed such that central portion 10 will still be substantially rectangular. However, peripheral portions 11 and 12, which serve as support for the reflector, will now be shaped as triangles. Similarly, ground member 2 will be formed such that central portion 20 will still be substantially rectangular. However, weakened fold lines 23 and 24 will now extend perpendicularly across the web, rather than obliquely, so that peripheral portions 21 and 22 will yet retain their triangular geometry.

Obviously, the reflector 1 may be used without the ground member 2 and yet provide many of the objects and advantages of the present invention. However, as noted above, the ground member serves as an added safety measure insofar as it protects the hearth area, generally, and the ash pit, particularly. Fireplaces, if not properly cleaned and serviced, are a significant source of accidental fires within the home. The predominant problem attendant repeated use of fireplaces is the oversight to properly clean the ash pit and dispose of spent embers. Continual use in this condition contributes to a propensity for the generation of temperatures in the sub-flooring above the flash point of the materials employed therefor, and can reasonably lead to catastrophic results. Not only does the ground member 2 protect the hearth area itself from degredation upon repeated use of the fireplace, but provides a convenient receptacle for spent embers to facilitate collection and easy disposal thereof, thus reducing the source of a prime contribution to house fires.

FIGS. 5 and 6 illustrate an alternate embodiment of the present invention, wherein the reflector and ground support members are formed unitarily and act in cooperation as a single member.

FIG. 6 shows the shield having the appropriate cut and fold lines formed thereon, having been fabricated in a fashion corresponding to that described above with reference to FIGS. 3 and 4. In this embodiment, a substantially rectangular web 3 of either aluminum sheeting or aluminum borne upon a fire-retardant substrate, is bisected longitudinally by weakened, longitudinal fold line 35. That portion 4, lying above fold line 35, corresponds to reflector 1 of FIG. 3, while that portion 5, lying below line 35, corresponds to the ground member 2 of FIG. 4. Upper, reflective member 4 is comprised of a central portion 30 bounded on either side by peripheral portions 31 and 32 along weakened transverse fold lines 33 and 34, respectively. Each of the weakened lines, 33 and 34, terminates at a point lying upon longitudinal fold line 35; these points designated as 45 and 46, respectively.

The lower member 5 is similarly divided into a central portion 40 bounded on either side by peripheral portions 41 and 42, about lines 43 and 44, respectively. Lines 43 and 44 are perforated cut lines which obliquely extend transversely across member 5 and terminate at the common points of intersection, 45 and 46, respectively. Obviously, as described above, appropriate cut and fold lines may be formed to provide a wide range of adjustability.

Having properly fabricated she web 3 with appropriate cut and fold lines therein, assembly into the configuration shown in FIG. 5 is quite simple. Should the shield be formed in such a manner as to be adjustabld, as described above, the consumer need merely select the appropriate lines in accordance with the detailed dimensions of the shield. Having done so, one should then fold member 4 into substantially orthogonal relationship with respect to member 5 about weakened, longitudinal fold line 35. Cut lines 43 and 44 are then severed up to the common points of intersection 45 and 46, respectively. Peripheral portions 31 and 32 may then be bent about weakened fold lines 33 and 34, respectively, into oblique relationship into central portion 30. Upon folding these peripheral portions 31 and 32, the peripheral portions of member 5 will be rotated beneath central portion 40 as shown in FIG. 5. Once assembled in this fashion, the shield 3 may then easily be inserted within the fireplace as generally shown in FIGS. 1 and 2.

FIG. 7 illustrates the laminated feature of the present invention. For limited or infrequent use, it has been found that simple aluminum sheeting functions admirably to achieve the objects and advantages of the present invention. However, for repeated or extended use, it has been determined that the integrity of the shield is enhanced by providing a laminated structure whereby the reflective web of aluminum is adhered or otherwise attached to a fire-retardant substrate. FIG. 7 illustrates such scheme wheqe the fire retardant substrate is designated 50. Suitable materials for use as substrate 50 are well within the purview of the skilled artisan: however, it has been determined that asbestos, fire-retardant cellulosic materials, and the like are most preferred for this purpose.

While the invention has now been described and illustrated with reference to certain preferred embodiments thereof, those skilled in the art will appreciate that various modifications, changes, omissions and substitutions may be made without departing from the spirit of the invention. It is intended, therefore that the inventon be limited only by the scope of the following claims.

What is claimed is:

1. In combination with a fireplace having a back wall, two opposing side walls and a bottom wall, a free-standing, removable reflector shield formed from a web of reflective metal, said shield including:

a. a reflector member comprising:

i. a reflector portion substantially conforming in shape to said back wall, and substantially contiguous therewith; and, ii. support portions substantially conforming to each of said side walls, said support portions each contiguous with opposite, transverse edges of said reflector portion about transverse, weakened fold lines; and, b. a ground member substantially conforming to and resting on said bottom wall, and defined as:

i. a central portion conforming to said bottom wall; and, ii. two peripheral portions contiguous with opposing edges of said central portion about transversely extending weakened fold lines, said peripheral portions being bent upwardly into cooperative relationship with said support portions;

whereby, each of said reflector member and said ground member is independently removable from said fireplace.

2. The shield of claim 1, wherein said reflective metal is aluminum.

3. The shield of claim 2, wherein said aluminum is 0.006 inches thick.

4. The shield of claim 1, wherein said web is a laminate of aluminum borne upon a fire-retardant substrate.

5. The shield of claim 4, wherein said substrate is asbestos.

6. The shield of claim 4, wherein said substrate is a cellulosic material impregnated with a fire-retardant chemical compound.

7. In combination with a fireplace having a back wall, two opposing side walls and a bottom wall, a free-standing, removable reflector shield formed from a web of reflective metal, said shield including a reflector member and a ground member of unitary construction, formed from a single reflective metal web of substantially rectangular configuration having:

a. a longitudinal weakened fold line extending from one transverse edge of said web to the other;

b. two transverse, perpendicular weakened fold lines extending from a first longitudinal edge of said web, each terminating at distinct first and second points lying on said longitudinal weakened fold line; and c. two transverse, oblique perforated cut lines extending from the second longitudinal edge of said web, the first of said perforated lines terminating at said first point and the second of said perforated lines terminating at said second point; whereby, said web is defined as a reflector member including reflector and support portions bent orthogonally with respect to a ground member about said longitudinal line said ground member further defined as a central portion conforming to said bottom wall, and two peripheral portions separated from said central portion by said cut lines, each of said peripheral portions being folded beneath said central portion.

8. The shield of claim 7, wherein said reflective metal is aluminum.

9. The shield of claim 8, wherein said aluminum is 0.006 inches thick.

10. The shield of claim 7, wherein said web is a laminate of aluminum borne upon a fire-retardant substrate.

11. The shield of claim 10, wherein said substrate is asbestos.

12. The shield of claim 10, wherein said substrate is a cellulosic material impregnated with a fire-retardant chemical compound.

* * * * *